US006896619B2

(12) United States Patent
Baltz et al.

(10) Patent No.: US 6,896,619 B2
(45) Date of Patent: May 24, 2005

(54) APPARATUS AND METHOD FOR A CASHLESS ACTUATED GAMING SYSTEM

(75) Inventors: F. Van Baltz, Las Vegas, NV (US); Stephanie Maddocks, Las Vegas, NV (US); Michael H. D'Amico, Las Vegas, NV (US); Alan G. Sheldon, North Las Vegas, NV (US); Lori J. McDermeit, Las Vegas, NV (US); J. Christopher McNamee, Las Vegas, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 73 days.

(21) Appl. No.: 09/960,696

(22) Filed: Sep. 21, 2001

(65) Prior Publication Data

US 2002/0128059 A1 Sep. 12, 2002

Related U.S. Application Data

(63) Continuation of application No. 09/693,183, filed on Oct. 19, 2000, now Pat. No. 6,676,515.

(51) Int. Cl.[7] ..... A63F 9/24

(52) U.S. Cl. ..... 463/25; 463/42; 273/138.2; 902/23

(58) Field of Search ..... 463/16–22, 12–13, 463/25, 40–42, 1, 29; 273/138.1, 138.2, 139, 143 R; 700/91–93; 235/375, 379–382; 705/1, 14; 902/23; 379/93.13

(56) References Cited

U.S. PATENT DOCUMENTS

| | | | |
|---|---|---|---|
| 4,072,930 A | 2/1978 | Lucero et al. | 340/152 T |
| 4,283,709 A | 8/1981 | Lucero et al. | 340/147 R |
| 4,517,656 A | 5/1985 | Solimeno et al. | 364/900 |
| 4,636,951 A | 1/1987 | Harlick | 364/412 |

(Continued)

FOREIGN PATENT DOCUMENTS

| | | |
|---|---|---|
| AU | 702021 | 1/1996 |
| DE | 3433774 | 3/1986 |
| DE | 4039732 | 8/1992 |
| EP | 0 051 579 | 5/1982 |
| EP | 0 208 857 | 1/1987 |
| EP | 0 219 306 | 4/1987 |
| EP | 0 588 625 A1 | 3/1994 |

(Continued)

OTHER PUBLICATIONS

The Regional SmarTrip System and the Regional Customer Service Center [http://www.itsva.org/downloads/files/samarasinghe.pdf], before May 1999, pps 1–16.*

Cash Ticket in the amount of $1.00—ticket No. 00010 dated Oct. 19, 2000.

Cash Ticket in the amount of $481.25—ticket No. 0166 validation Oct. 19, 2000.

*Primary Examiner*—Mark Sager
(74) *Attorney, Agent, or Firm*—McAndrews, Held & Malloy, Ltd.

(57) ABSTRACT

A gaming machine adapted to print validated tickets for a game player includes a microprocessor for controlling game operation (e.g., slot machine operation) and including a cashout signal input, a network interface coupled to the microprocessor for communicating with a central authority, and a memory in the network interface that stores a pre-loaded ticket validation number received from the central authority. In addition, a ticket printer is coupled to the microprocessor for printing a ticket that includes pending credit indicia and pre-loaded ticket validation indicia in response to a cashout signal on the cashout signal input. After the ticket is printed, the gaming machine obtains a new pre-loaded validation number in preparation for the next ticket printing event.

15 Claims, 5 Drawing Sheets

U.S. PATENT DOCUMENTS

| | | | | | |
|---|---|---|---|---|---|
| 5,265,874 | A | * | 11/1993 | Dickinson et al. | 463/25 |
| 5,290,033 | A | | 3/1994 | Bittner et al. | 273/138 A |
| 5,429,361 | A | | 7/1995 | Raven et al. | 273/138 A |
| 5,470,079 | A | | 11/1995 | LeStrange et al. | 273/138 A |
| 5,766,075 | A | | 6/1998 | Cook et al. | 463/25 |
| 5,871,398 | A | * | 2/1999 | Schneier et al. | 463/16 |
| 6,048,269 | A | * | 4/2000 | Burns et al. | 463/25 |
| 6,251,014 | B1 | * | 6/2001 | Stockdale et al. | 463/16 |
| 6,254,483 | B1 | | 7/2001 | Acres | 463/26 |
| 6,280,326 | B1 | * | 8/2001 | Saunders | 463/25 |
| 6,319,125 | B1 | | 11/2001 | Acres | 463/25 |
| 6,394,907 | B1 | * | 5/2002 | Rowe | 463/42 |

FOREIGN PATENT DOCUMENTS

| | | |
|---|---|---|
| GB | 1 545 301 | 5/1979 |
| GB | 2 151 054 A | 7/1985 |
| GB | 2 236 423 A | 4/1991 |
| GB | 2 241 098 A | 8/1991 |
| GB | 2 282 690 A | 4/1995 |
| WO | WO 98/35309 | 8/1998 |
| WO | WO 98/40140 | 9/1998 |

* cited by examiner

200

APPARATUS AND METHOD FOR A CASHLESS ACTUATED GAMING SYSTEM

CROSS-REFERENCE TO RELATED APPLICATION

This is a continuation of U.S. application Ser. No. 09/693,183 entitled APPARATUS AND METHOD FOR A SECURE TICKET ACTUATED GAMING SYSTEM filed Oct. 19, 2000 now U.S. Pat. No. 6,676,515.

STATEMENT REGARDING FEDERALLY SPONSORED RESEARCH OR DEVELOPMENT

Not applicable.

FIELD OF THE INVENTION

The present invention relates generally to a ticketing gaming system and, more particularly, to a gaming system that encompasses printing and validation of tickets with ticket validation numbers pre-loaded by a central computer system to individual gaming machines.

BACKGROUND OF THE INVENTION

Gaming machines, particularly slot machines, have in recent years become one of the more popular, exciting, and sophisticated wagering activities available at casinos and other gambling locations. At the same time, slot machines have also become a source of greater revenue for gaming establishments.

Typically, a player, when finished playing, "cashes out" at the slot machine by activating a cashout button. At that time, the slot machine converts the amount of credits pending in the slot machine to a currency payout that is dispensed (e.g., as coins) to the player. The player must then collect all of the coins, fill a cup or pockets, then move to the next slot machine and reenter all of the coins. Thus, the prior payout techniques tended to interrupt gameplay, thereby reducing profits and also reducing the excitement and entertainment experience that arise from uninterrupted game play.

In the past, slot machines have attempted to address the interruption caused when a player collects coins and moves to another slot machine. In particular, some slot machines have issued paper tickets that encode the amount of credit pending in the slot machine when the player presses the cashout button. The player may then simply pick up the ticket dispensed by the slot machine and proceed to a new slot machine without incurring the time delay and distraction associated with collecting currency and reinserting it into the new slot machine.

Successful ticketing, however, requires a comprehensive system level approach to ensure that the tickets are secure (e.g., they cannot be duplicated and reused, they cannot be forged, and the like), that as many slot machines as possible can accept tickets, and that ticketing does not cause as much interruption as the coin/currency payout that the tickets are designed to replace. However, in prior ticketing systems for example, the slot machines typically had to spend the time and processing resources to generate their own ticket validation numbers, or had to incur the delay of requesting a ticket validation number from a central authority each time the slot machine needed to print a ticket. As a result, prior slot machines exposed the player to unnecessary processing delay, thereby slowing play, and reducing the overall level of player enjoyment.

A need has long existed in the industry for a secure ticket actuated gaming system that addresses the problems noted above and other previously experienced.

SUMMARY OF THE INVENTION

An apparatus embodiment of the invention is suitable for use in a gaming system. In such an environment, a medium, such as a ticket, may be validated by providing a gaming machine comprising:

(1) a display arranged to display a credit amount;

(2) a medium generator arranged to generate a medium comprising a machine-readable validation code and a non-machine readable credit amount;

(3) a reader unit arranged to read the validation code from the medium; and (4) a network interface;

(B) a network; and (C) a central authority arranged to store the validation code and a credit amount received from the network in response to generating the medium, arranged to validate the validation code and arranged to transmit the stored credit amount through the network to the interface in response to validation of the validation code, the credit amount being displayed on the display.

A method embodiment of the invention is useful in a gaming system comprising a gaming machine. In such an environment, a medium, such as a ticket, may be validated by a method comprising:

generating a machine-readable validation code and a non-machine readable credit amount on the medium;

reading the validation code from the medium;

storing the validation code and a credit amount in response to generating the validation code on the medium;

validating the validation code;

transmitting the stored credit amount to the gaming machine in response to validation of the validation code; and displaying the credit amount.

DETAILED DESCRIPTION OF THE PREFERRED EMBODIMENTS

Figure 1:
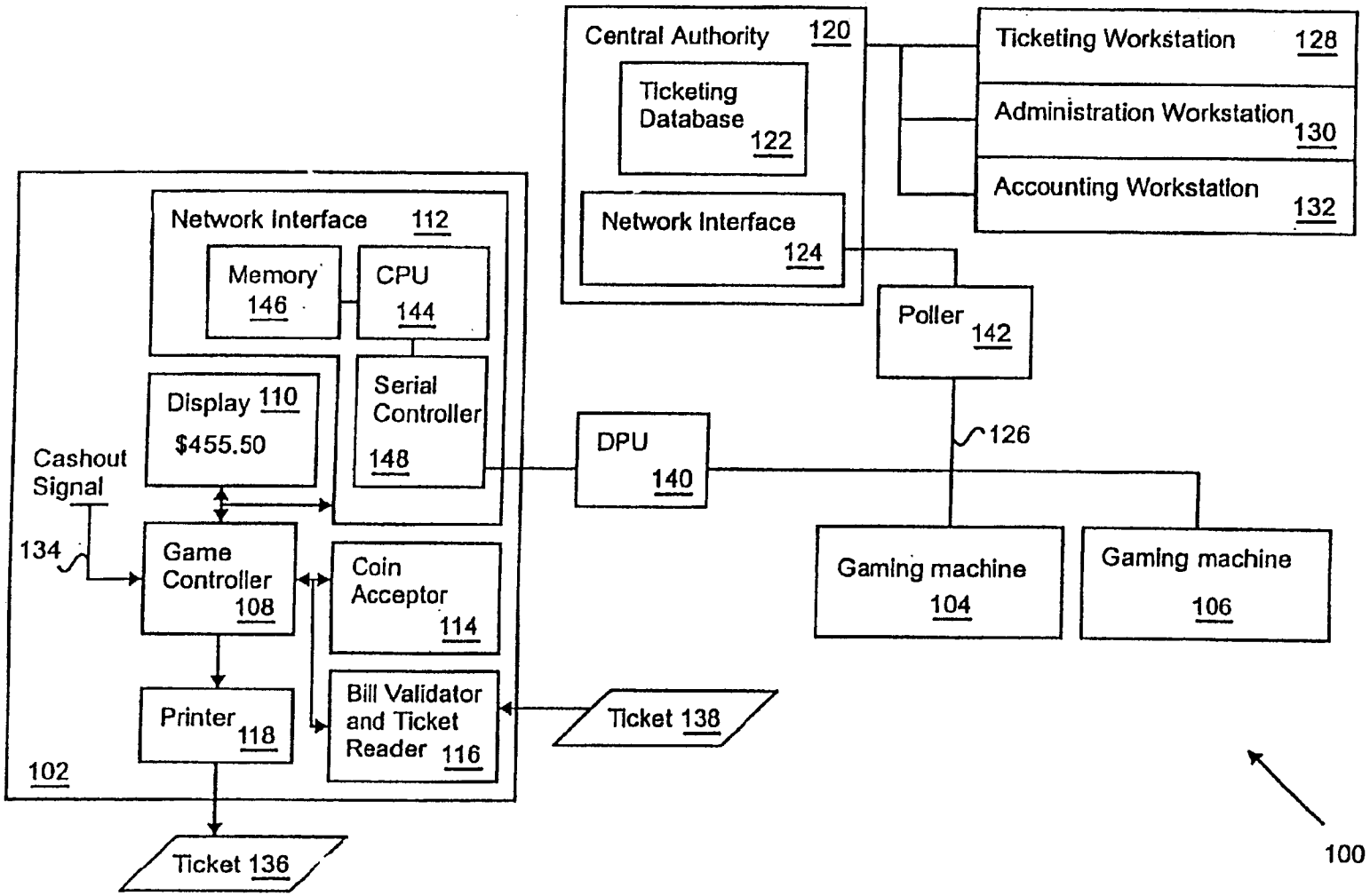
FIG. 1 illustrates a block diagram of a gaming network.

Referring to FIG. 1, a gaming network 100 includes several gaming machines 102, 104, 106. The gaming machines 102–106 may be implemented, for example, as slot machines, video poker machines, video roulette machines, and the like. Each gaming machine 102–106 includes a game controller 108, a display 110, and a network interface 112. The network interface 112 may be, for example, an RS485 interface such as that implemented by a Sentinel™ Interface from Casino Data Systems. Other interfaces and network architectures (e.g., Ethernet, parallel port, and the like) may be substituted however. Furthermore, the network interface 112 may adhere to, for example, the IGT Gaming SAS™ communication protocol, the CDS GDAP™ communication protocol, a custom protocol, or another third party communication protocol for establishing and maintaining communication with the gaming machine 102. The network interface 112 may be physically present inside the gaming machine 102, or may be located externally and coupled to the gaming machine 102. Each gaming machine 102–106 further includes a coin acceptor 114, a bill validator/ticket reader 116, and a ticket printer 118.

As will be explained in more detail below, the game controller 108 is responsive to the cashout signal 134 to print a ticket 136 on paper, or other suitable material. Additionally, previously printed tickets (e.g., the ticket 138) may be redeemed by the gaming machines 102–106. The gaming network also includes a central authority or host computer system 120. The central authority 120 includes a ticketing database 122 and a network interface 124 for connection over the network medium 126 to the gaming machines 102–106. Support systems connect to the central authority 120, including a ticketing workstation 128, an administration workstation 130, and an accounting workstation 132.

A dataport unit (DPU) 140 is provided as a data concentrator and buffering communication unit to address multiple gaming machines and to communicate with the poller 142. The poller 142, in turn, communicates with the DPU 140 and the central authority 120. The network interface 112 may be generally configured as shown in FIG. 1 to include a CPU 144, a program and data memory 146, and a serial controller 148.

The game controller 108 is responsible for operation of the gaming device 102. Thus the game controller 108 may include a microprocessor, memory, game software, and support circuitry to implement a slot machine or other type of game. The display 110 presents to the player a representation of the pending credit in the gaming machine 102 (e.g., $455.50 as shown in FIG. 1). During play, the game controller 108 tracks the pending credit according to the rules of the game and the interaction with the player (including the deposit of additional funds via the coin acceptor 114 and bill validator 116), and further monitors for assertion of the cashout signal 134. Thus, the central authority 120 need not monitor the pending credit in each gaming machine 102–106, as each gaming machine 102–106 preferably tracks the pending credit locally and independently of the central authority 120.

In response to the cashout signal 134, the game controller 108 prints the ticket 136 which may be redeemed later at other gaming machines 102–106 or at independent workstations with ticket readers. The cashout signal 134 may be generated by a player actuated switch, touchscreen input, or the like. As will be explained in more detail below, the game controller 108 prints the ticket 136 with a pre-loaded ticket validation number obtained from the central authority 120 through the network interfaces 112, 124 and over the network medium 126. The central authority 120 uses an encryption algorithm to generate validation numbers. Preferably, the algorithm is based at least on time and/or date as well as a gaming machine number.

The ticketing database 122, described in more detail with reference to Tables 1–3 below, stores information obtained from the gaming machines 102–106, as well as locally generated validation numbers. The ticketing workstation 128 provides cash redemption of tickets outside of gaming machines, the administration workstation 130 provides an interface for setting up system parameters, and the accounting workstation 132 provides for ticket and gaming machine accounting functions. Note that in general, when a ticket validation number is pre-loaded onto the network interface board, the ticket validation number is also pre-stored in a ticketing database (albeit without an associated pending credit amount). Thus, should the gaming network fail, validation may still occur through human intervention.

Figure 2:
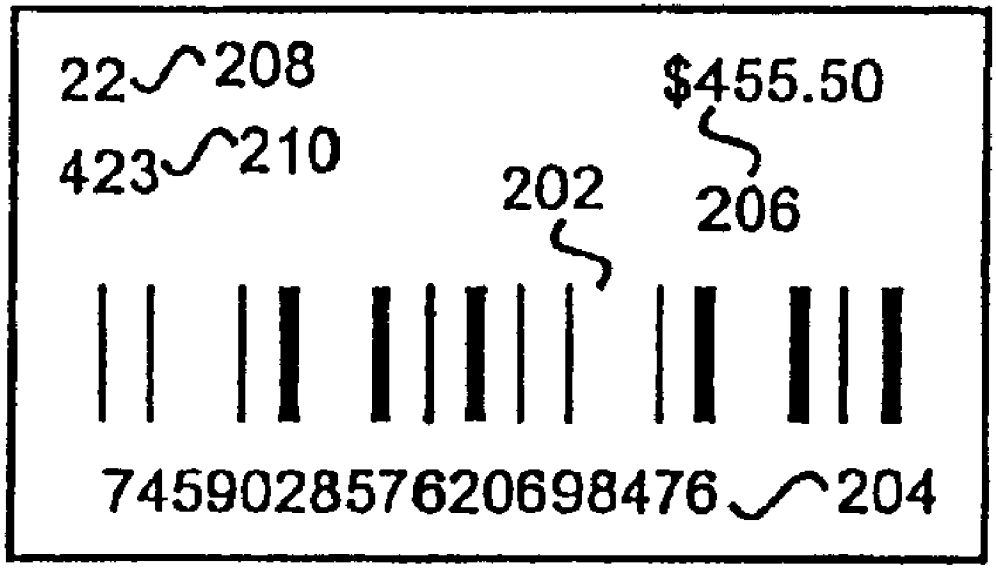
FIG. 2 shows a front view of a ticket used with the gaming network.

Turning next to FIG. 2, a ticket 200 includes a validation number bar code 202 (e.g., in JCM or Code 205 format), a human intelligible validation number 204, and a human intelligible pending credit amount 206. The ticket 200, as shown, also includes a machine number 208 and a ticket number 210 (e.g., a sequential ticket number generated in the gaming machine 102). Note that the validation number bar code 202 is a machine readable representation of a pre-loaded validation number (as discussed in more detail below) but that the validation number bar code 202 generally does not encode other information (e.g., the pending credit amount). In other words, the ticket 200, when it is advantageous to do so, may omit a machine readable pending credit amount. Additional information may also be printed on the ticket 200, including a date/time of cashout, casino name, ticket expiration date, and the like.

Figure 3:
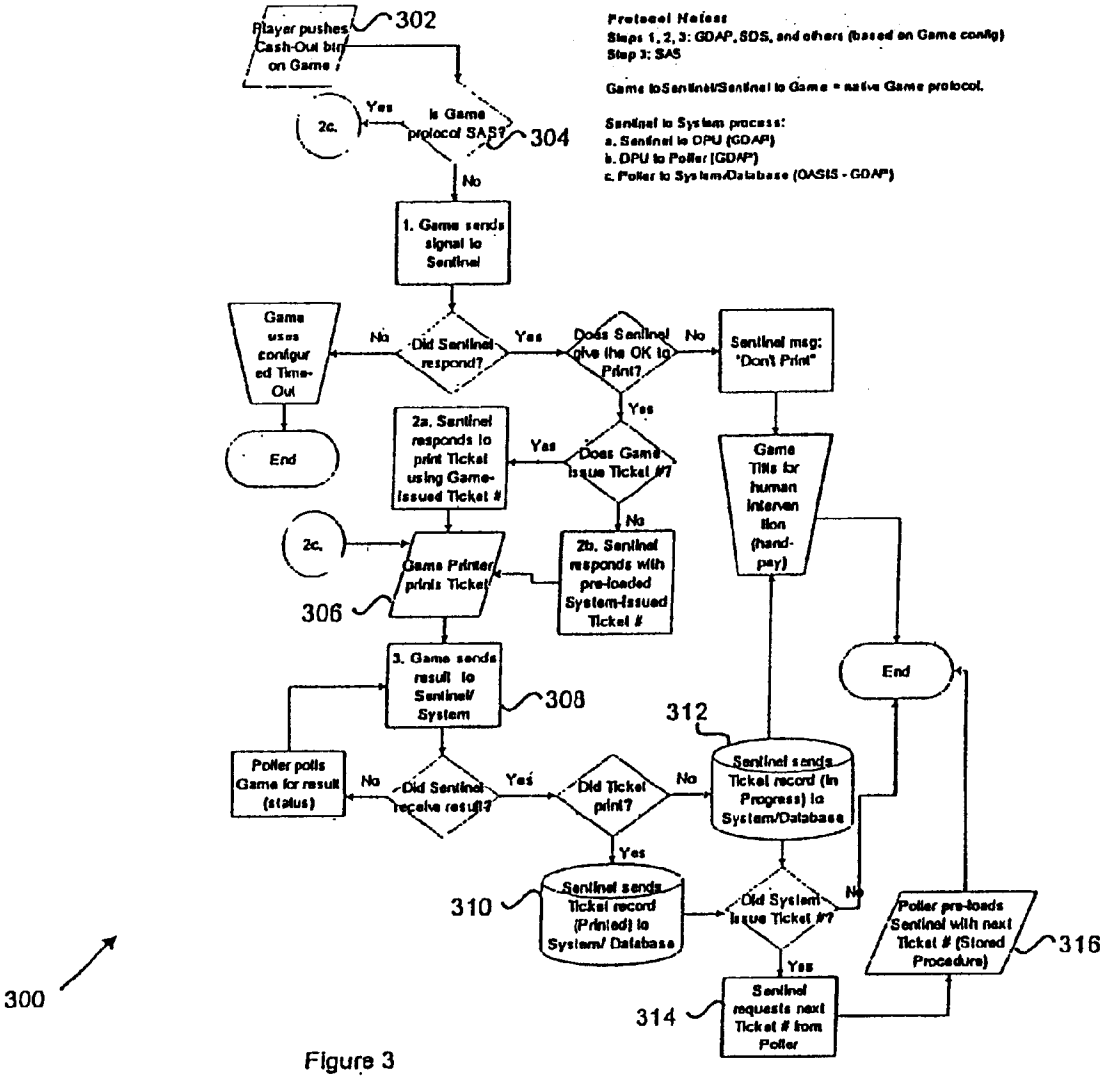
FIG. 3 depicts a flow diagram for issuing a validated ticket from a gaming machine in the gaming network.

With regard to FIG. 3, a flow diagram 300 shows a ticket printing method that may be implemented in hardware and/or software in the gaming device 102. In FIG. 3, the Sentinel refers to the network interface 112, the poller refers to the poller 142, and the system/database refers to the central authority 120 and its ticketing database 122. The method includes monitoring (302) for a player to press a cashout button and thereby generate the cashout signal 134. Next, the method determines (304) whether a communication protocol (in this case SAS) is running on the gaming system 100 that supports central authority 120 generation of ticket validation numbers. If so, the method proceeds to obtain a pre-loaded validation number from the network interface 112 and print (306) the ticket.

The method continues by sending (308) a ticket printing result (e.g., successful or unsuccessful) to the central authority 120 through the network interface 112. If the ticket is printed successfully, the method sends (310) ticket information for a Printed ticket to the central authority 120 through the network interface 112. The Printed ticket information includes Casino name, ticket date and time, validation number, a bar code representing the validation number, a numeric pending credit amount, an alphanumeric description of the pending amount, a machine number, and a ticket number (typically up to 9999 and sequentially generated at each gaming machine). Otherwise, the method sends (312) an In Progress lock for the ticket to the central authority 120. If the central authority 120 generates ticket validation numbers, then the network interface 112 requests (314) a new ticket validation number from the central authority 120. Subsequently, the network interface 112 receives (316) the new ticket validation number and pre-loads it into a memory (e.g., the memory 146) for use before the next ticket is printed. Thus, a ticket validation number is immediately available when the player activates the cashout button.

The ticketing database 122 in the central authority may store, for example, the fields set forth below in Table 1 for Ticket Information, Table 2 for Ticket Detail, and Table 3 for Ticket Information.

TABLE 1

Ticket Info

| Field | Definition | Description |
|---|---|---|
| RecordNum | Int | Auto-incremented system transaction record number. |
| ValidationDigits | TinyInt | # of digits in validation number |
| ValidationNumber | VarChar(32) | Bar Code Number. |
| MachineNumber | Int | Machine number printed on ticket |
| TicketNumber | Int | Game's sequential ticket #, for example 0000 to 9999 |
| AmountType | TinyInt | See below. |
| Amount | Int | |
| Status | TinyInt | See below. |
| StatusDateTime | DateTime | Application time of last Status change. |
| IssuedDateTime | DateTime | Application time table updated. |
| IssuedAppID | SmallInt | Application code: 8 = Poller. |
| IssuedLocation_ID | Int | Workstation, or PollerID If AppID = 8 |
| IssuedID | Int | Machine number if AppID = Poller. |
| PrintedDateTime | DateTime | Date & Time on ticket. |
| PrintedAppID | SmallInt | Application code: 8 = Poller |
| PrintedLocation_ID | Int | Workstation, or PollerID if AppID = 8 |
| PrintedID | Int | SlotMast_ID if AppID = Poller. User_ID if manually entered. |
| PrintedOCR | Char(10) | Player Card Number, if available. |
| RedeemedDateTime | DateTime | Application time table updated. |
| RedeemedAppID | SmallInt | Application code: 8 = Poller. 19 = Ticketing System. |
| Redeemed-Location_ID | Int | Workstation, or PollerID if AppID = 8 |
| RedeemedID | Int | SlotMast_ID if AppID = Poller. User_ID if manually redeemed. |
| RedeemedOverrideID | Int | User_ID of person who authorized override, if required for redeem. |
| RedeemedOCR | Char(10) | Player card number, if available. |
| ExpiredDateTime | DateTime | Application time table updated. |
| ExpiredAppID | SmallInt | Application code: 8 = Poller |
| ExpiredLocation_ID | Int | PollerID if AppID = 8, Workstation if AppID = 19. |
| ExpiredID | Int | User_ID for manual expiration. NULL if expired by Poller. |
| VoidedDateTime | DateTime | Application time table updated. |
| VoidedAppID | SmallInt | Application code: 8 = Poller. |
| VoidedLocation_ID | Int | Workstation, or PollerID if AppID = 8 |
| VoidedID | Int | User_ID for manual void. May be SlotMast_ID or NULL if voided by Poller. |
| DetailCount | Int | Number of detail records for ticket. |

TABLE 2

Ticket Detail

| Field | Definition | Description |
|---|---|---|
| RecordNum | Int | |
| TimeStamp | DateTime | Application time table updated. |
| GameDateTime | DateTime | Time on ticket if ActionCode = Printed. |
| ValidationDigits | TinyInt | # of digits in ValidationNumber. |
| ValidationNumber | VarChar(32) | Bar Code Number |
| MachineNumber | Int | Machine number. |
| AmountType | TinyInt | See below. |
| Amount | Int | |
| ExpirationType | TinyInt | Present if ActionCode = Printed |
| ExpirationDuration | SmallInt | Present if ActionCode = Printed. |
| ActionCode | TinyInt | Game/Sentinel event. See below. |
| ResultCode | TinyInt | Event from System to Sentinel/Game |
| ResultSubCode | Int | Error/warning code by System. |

TABLE 2-continued

Ticket Detail

| Field | Definition | Description |
|---|---|---|
| StatusIn | TinyInt | Status of ValidationNumber in Ticket Info before processing detail information. See below. |
| StatusOut | TinyInt | Status of ValidationNumber in Ticket Info after processing detail information. See below. |
| OCR | Char(10) | Player card number, if available. |
| AppID | SmallInt | Application code: 8 = Poller, Ticketing System = 19 |
| Location_ID | Int | Workstation, or PollerID if AppID = 8 |
| UpdateID | Int | User_ID, SlotMast_ID if AppID = 8 |
| OverrideID | Int | User_ID if required for redemption. |
| TransDate | DateTime | To match with buffer transactions. |
| SiteID | TinyInt | Site of Poller or application |
| PollerID | TinyInt | To match with buffer transactions. |
| DpuID | TinyInt | To match with buffer transactions. |
| SenID | TinyInt | To match with buffer transactions. |
| SlotMast_ID | Int | To match with buffer transactions. |
| IsDamaged | Char | 'N' or 'Y'. Defaults to 'N'. |

TABLE 3

Ticket Information

| Field | Definition | Description |
|---|---|---|
| Validation Number | VarcChar(32) | Bar Code Number |
| TimeStamp | DateTime | Application time row was added. |
| Link0 | SmallInt | Application Code: 8 = poller |
| Link1 | Int | Update ID If link0 = 8 then machine ID with redeem lock. Otherwise, UserID with lock. |
| Link2 | Int | Location ID If link0 = 8 then Poller ID that locked. Otherwise, Workstation with lock. |

Figure 4:
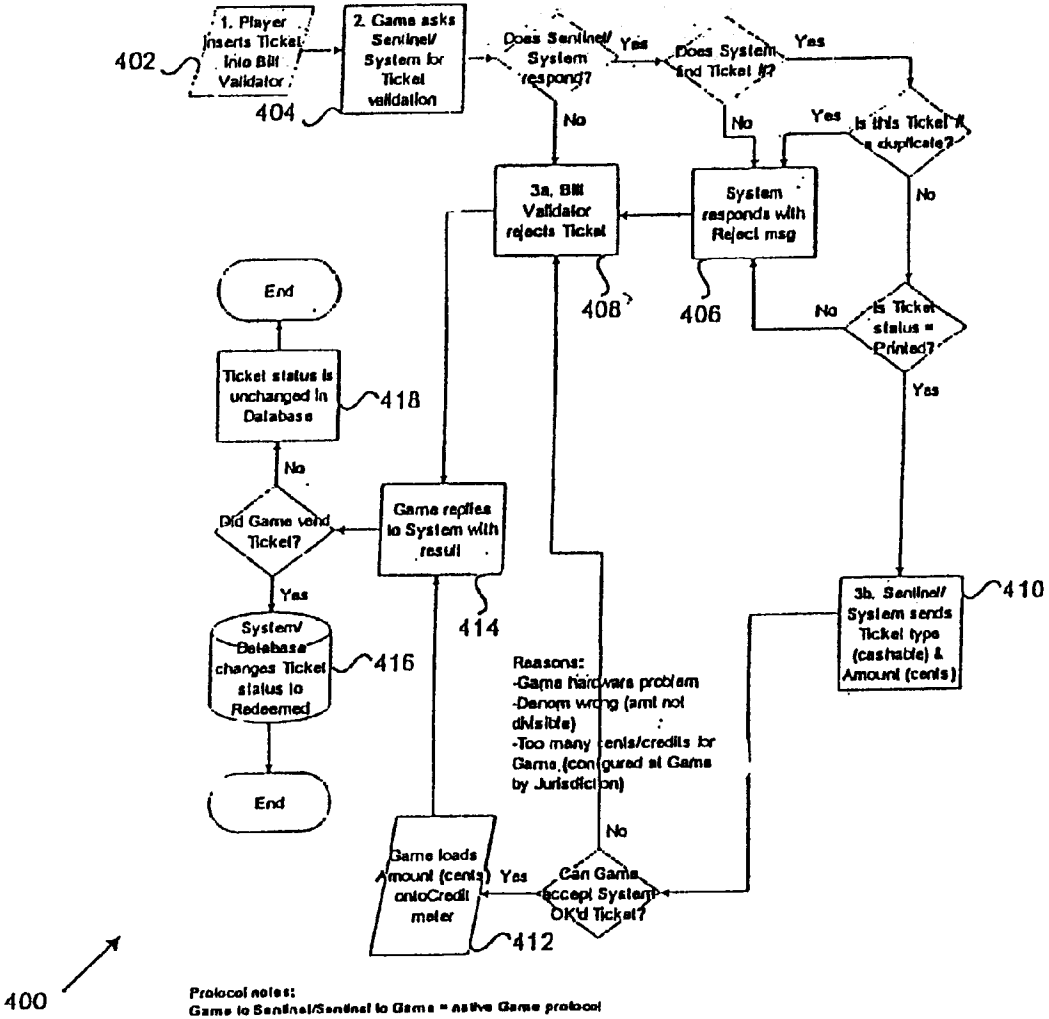
FIG. 4 shows a flow diagram for redeeming a ticket in a gaming network.

Turning next to FIG. 4, a flow diagram 400 shows a ticket redemption method that may be implemented in hardware and/or software in the gaming network 100. In FIG. 4, the Sentinel refers to the network interface 112, the poller refers to the poller 142, and the system/database refers to the central authority 120 and its ticketing database 122. Beginning at step 402, a player inserts a ticket into a gaming machine. The gaming machine proceeds to query (404) the system for ticket validation of the validation number bar code 202. In general, the pending credit printed on the ticket is not read by the ticket reader. Rather, the system itself responds with the pending credit as explained below.

If the system responds (e.g., communication is up), then the system attempts to find the validation number in its database. If not found, the system responds (406) to the gaming machine with a Reject Message. Otherwise, the system checks the ticketing database 122 to determine if the ticket is a duplicate. If so, the system also responds (406) to the gaming machine with a Reject Message. If the validation number is not a duplicate, then the system determines whether the ticket status as recorded in the ticketing database 122 is issued and redeemable (i.e., it has not already been redeemed for money). If not, the system again responds (406) to the gaming machine with a Reject Message. The ticket/bill validator then rejects (408) the ticket.

However, if the ticket was, in fact, successfully printed, the system responds (410) to the gaming machine (and the network interface 112) in particular, with the ticket type and the amount (e.g., in cents). If the gaming machine can accept the ticket (in the absence of a hardware problem, an amount not divisible by a certain unit, an amount too great for the game, and the like), then the game loads (412) the amount into its credit meter. Subsequently, the gaming machine replies (414) to the system with the ticket processing result (e.g., rejected or accepted).

If the gaming machine accepted the ticket and credited its credit meter, then the system changes (416) the ticket status in the ticketing database 122 to Redeemed. As a result, the redeemed ticket is not useable to activate other gaming machines. Rather, additional tickets (or a ticket newly printed upon cashout) would be used to activate additional gaming machines. Continuing with reference to FIG. 4, if the ticket is not accepted, the ticket status remains (418) unchanged in the ticketing database 122.

Figure 5:
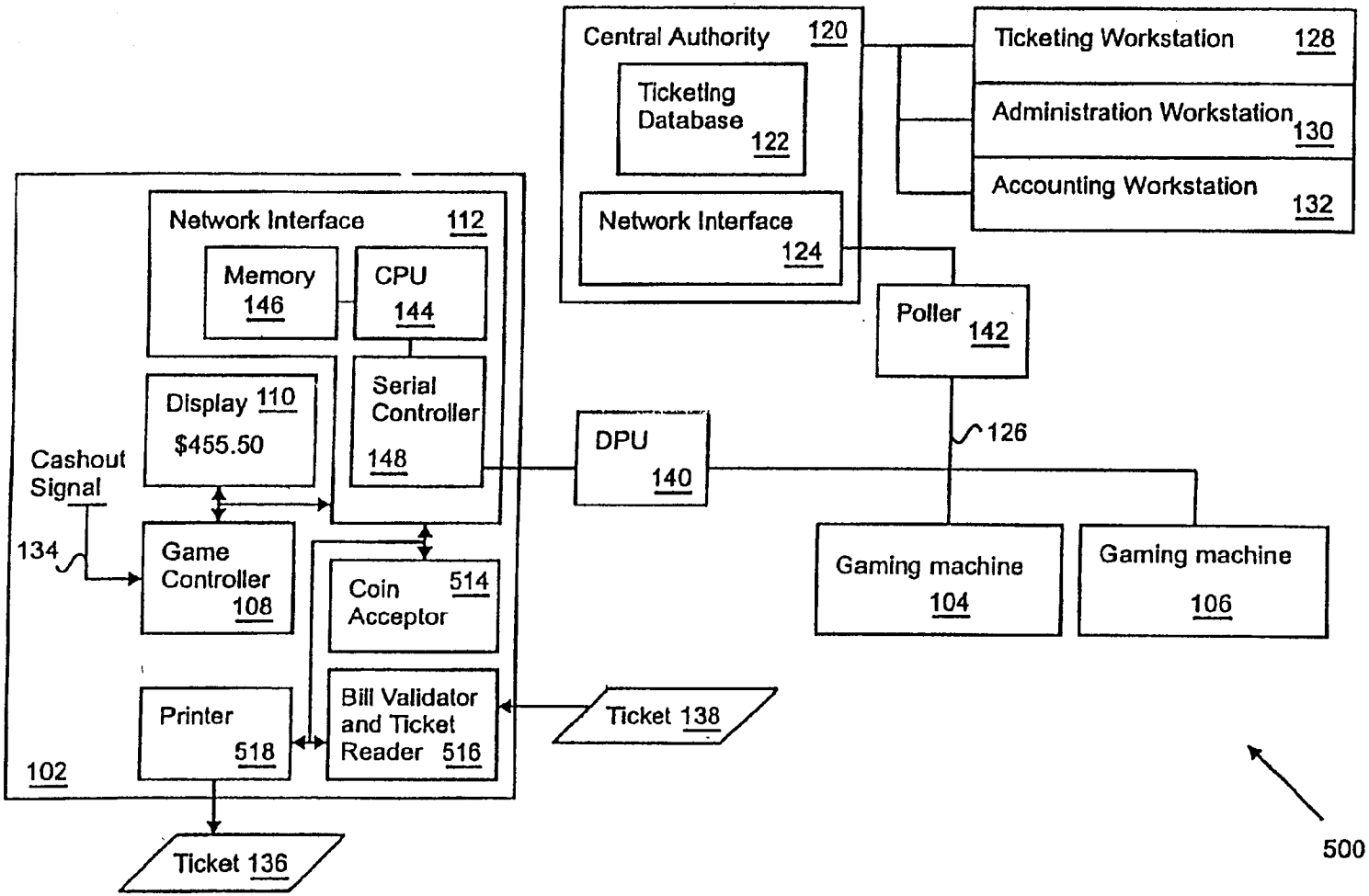
FIG. 5 illustrates a block diagram of a gaming network in which a central authority exercises direct control over a validator, a ticket printer, and a ticket reader.

With reference next to FIG. 5, a block diagram of a gaming network 500 illustrates central authority control over a coin acceptor 514, a bill validator/ticket reader 516, and a ticket printer 518. FIG. 5 is similar to FIG. 1, and like reference numerals denote like parts. Note, however, that the coin acceptor 514, bill validator/ticket reader 516, and ticket printer 518 are connected directly to the network interface 112 rather than to the game controller 108.

As a result, the central authority 120 may exercise control over the coin acceptor 514, bill validator/ticket reader 516, and ticket printer 518 through the network interface 112. The game controller 108 is thereby relieved of those duties. Furthermore, existing gaming machines that do not allow convenient game controller ticket printing, reading, and bill validation may nevertheless issue and redeem tickets when fitted with the network interface 112.

When a ticket is inserted into the ticket reader 516, the network interface 112 reads the ticket directly and proceeds to verify the validation number bar code with the central authority 120 as explained above. Valid tickets result in credit applied to the gaming machine 102 using, for example, an Electronic Funds Transfer (EFT) message from the central authority 120. In addition, the network interface 112 may also read standard currency (e.g., bills and coins) and appropriately report to the central authority 120. Again the central authority may respond with an EFT message to the gaming machine 102. Alternatively, the network interface 112 may determine the amount of standard currency inserted and report that amount directly to the gaming machine 102 (which may then appropriately increment its bill and coin meters). In that regard, the network interface 112 may act as a filter, such that only printed tickets generate appreciable network traffic to the central authority 120.

Thus, the present invention provides a secure ticket actuated gaming network. In particular, the gaming machines pre-load ticket validation numbers in preparation for printing a cashout ticket. As a result, the player need not wait while the gaming machine generates or requests a new validation number.

While the invention has been described with reference to a preferred embodiment, those skilled in the art will understand that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. A gaming system comprising:

(A) a gaming machine comprising:

(1) a display arranged to display a credit amount;

(2) a medium generator arranged to generate a print medium comprising a machine-readable validation code to the exclusion of a machine-readable credit amount;

(3) a reader unit arranged to read the validation code from the print medium; and (4) a network interface;

(B) a network; and (C) a central authority arranged to store the validation code and a credit amount received from the network in response to generating the print medium, arranged to validate the validation code and arranged to transmit the stored credit amount through the network to the interface in response to validation of the validation code, the credit amount being displayed on the display.

2. A gaming system according to claim 1 wherein the gaming machine comprises one of a slot machine, a video poker machine and a video roulette machine.

3. A gaming system according to claim 1 wherein the medium comprises a ticket and wherein the medium generator comprises a ticket printer.

4. A gaming system according to claim 1 wherein the gaming machine generates a cashout signal in response to manual activation.

5. A gaming system according to claim 4 wherein the medium generator is responsive to the cashout signal.

6. A gaming system according to claim 4 wherein the central authority is arranged to service a plurality of gaming machines including a plurality of interfaces and wherein the central authority transmits to the interfaces through the network validation codes before cashout signals are generated.

7. A gaming system according to claim 1 wherein the central authority determines whether the medium read by the reader unit has been redeemed.

8. A gaming system according to claim 1 wherein the central authority stores a medium type received from the network in response to generating the medium and wherein the central authority transmits the medium type to the interface over the network in response to validation of the validation code.

9. In a gaming system comprising a gaming machine, a method of validating a print medium comprising:

generating a machine-readable validation code on the print medium;

excluding a machine-readable credit amount from the print medium;

reading the validation code from the print medium;

storing the validation code and a credit amount in response to generating the validation code on the print medium;

validating the validation code;

transmitting the stored credit amount to the gaming machine in response to validation of the validation code; and displaying the credit amount.

10. A method according to claim 9 wherein the gaming machine comprises one of a slot machine, a video poker machine and a video roulette machine.

11. A method according to claim 9 wherein generating a machine-readable validation code on the medium comprises printing the validation code on the medium.

12. A method according to claim 9 wherein the generating a machine-readable validation code is responsive to generation of a first cashout signal.

13. A method according to claim 12 wherein the validation code comprises a first validation code, and wherein the method further comprises storing a second validation code in the gaming machine before generation of a second cashout signal occurring later in time than the first cashout signal.

14. A method according to claim 9 and further comprising determining whether the medium bearing the validation code read by the step of reading has been redeemed.

15. A method according to claim 9 and further comprising storing a medium type in response to generating a machine readable validation code on the medium and transmitting the medium type to the gaming machine in response to validating the validation code.

* * * * *